US005136963A

United States Patent [19]

Zuzik

[11] Patent Number: 5,136,963

[45] Date of Patent: Aug. 11, 1992

[54] DECK EXTENSION FOR A BOAT

[76] Inventor: Kenneth P. Zuzik, 4595 Clearview Dr., Canfield, Ohio 44406

[21] Appl. No.: 698,276

[22] Filed: May 10, 1991

[51] Int. Cl.[5] ..... B63B 17/00

[52] U.S. Cl. ..... 114/363; 114/343

[58] Field of Search ..... 114/343, 363, 255; 297/118, 119, 129

[56] References Cited

U.S. PATENT DOCUMENTS 2,472,185 6/1949 Apel ..... 114/363
3,475,773 11/1969 Codman, Jr. ..... 114/363
3,805,722 4/1974 Melchert, Jr. et al. ..... 114/343
4,085,473 4/1978 Franklin ..... 114/363
4,738,217 4/1988 Smith ..... 114/363

*Primary Examiner*—Edwin L. Swinehart
*Attorney, Agent, or Firm*—Harpman & Harpman

[57] ABSTRACT

A deck extension for pleasure boats that extends rearwardly from the stern of the boat to define an extended sun deck surface. The deck extension includes a hinged multi-part support frame having integral support leg assemblies that automatically deploy upon deck extension. A second embodiment of support legs are deployed manually in a conventional manner to support the deck extension on the boat.

3 Claims, 2 Drawing Sheets

DECK EXTENSION FOR A BOAT

BACKGROUND OF THE INVENTION

1. Technical Field

This device relates to small pleasure boats that have minimal usable deck surfaces due to the boat configuration and intended use. Devices of this type are extensions for boats that extend from the stern of the boat for additional deck surface used for a wide variety of applications.

2. Description of Prior Art

Prior Art devices of this type have relied on a variety of different configurations, all of which provide modified forms of extension frame work that can be extended from a boat to increase usable surface area in the form of pivoted racks for fishing, net usage to platform extensions, see for example U.S. Pat. Nos. 3,475,773, 3,805,722 and 4,085,473.

In U.S. Pat. No. 3,475,773 a convertible boat hull is disclosed wherein a cabin extension is stored completed within the hull of the boat. The extension can be raised by one person that includes multiple bunk surfaces, side walls and an enclosed top.

U.S. Pat. No. 3,805,722 is directed to a boat rack that provides a stern support of a fishing net. The extension is characterized by an open framework with multiple fixed support arms extending from the frame to the boat. The boat rack is pivotally attached to the stern of the fishing boat.

In U.S. Pat. No. 4,085,473 a fishing deck platform extension for boats can be seen having a removable platform attached to the stern of the boat. Adjustable angle supports are permanently secured to the stern of the boat and can be extended and locked into place to support the deck extension positioned on the boat.

SUMMARY OF THE INVENTION

A sun deck extension for pleasure boats and the like wherein a self-contained multi-part hinged platform is positioned on a boat adjacent the stern. The sun deck extension unfolds with self-contained support legs deploying for support of the deck on a portion of the boat.

DESCRIPTION OF THE PREFERRED EMBODIMENT

Figure 1:
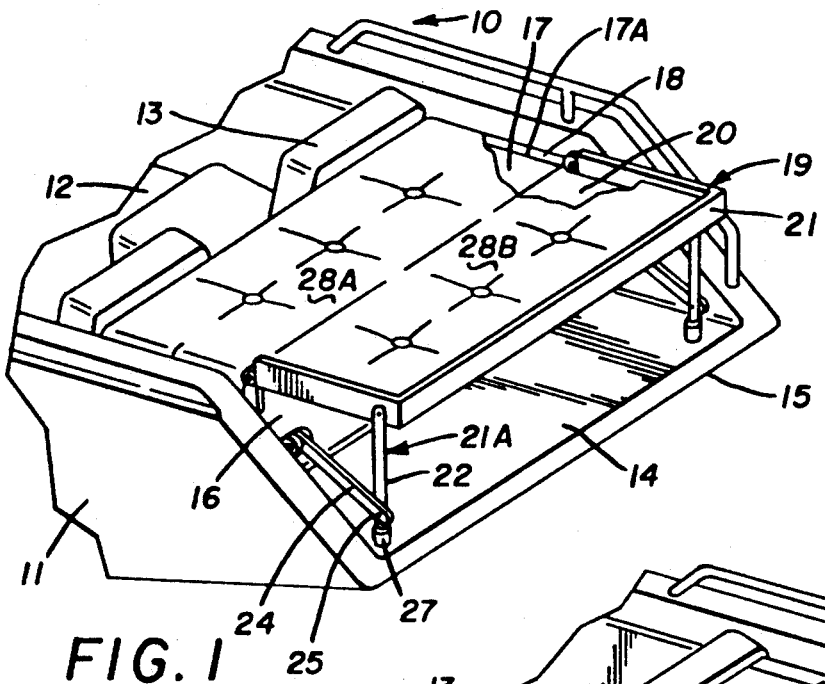
FIG. 1 is a partial perspective view of a boat with a sun deck extension extending therefrom.
Figure 2:
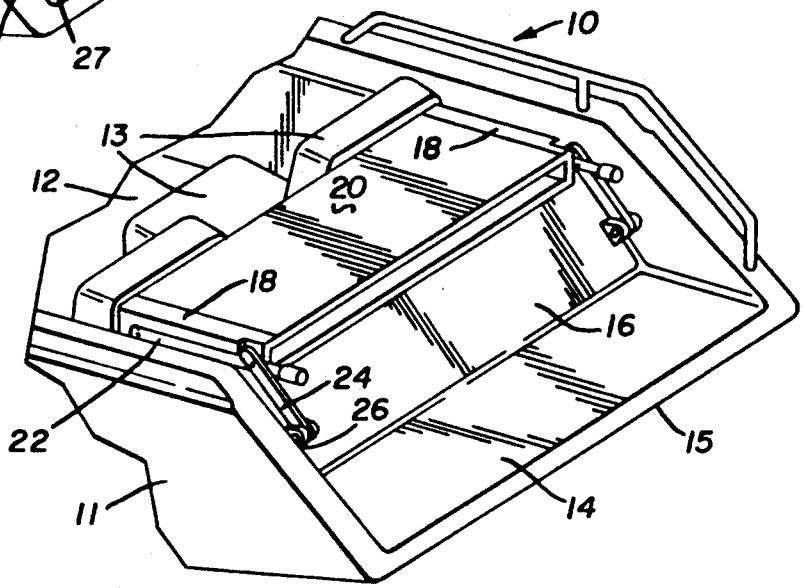
FIG. 2 is a partial perspective view of the stern portion of the boat with the sun deck extension in folded closed position.

A sun deck extension for a power boat 10 having a hull 11, internal deck surface 12, a pair of seats 13. The power boat 10 used in this example has an upper boat deck 13A extending from said seats 13 to a lower deck 14 commonly referred to as a swimming platform defining the stern of the boat at 15 generally. An angularly inclined transition area 16 extends from and between said upper and lower decks 13A and 14 as will be well known by those skilled in the art. The sun deck extension comprises a first deck platform 17 secured to the upper boat deck 13A. The first deck platform 17 is of a generally rectangular flat configuration, best seen in FIGS. 1, 2, and 3 of the drawings. A hinge support and reinforcing element 18 is secured to first deck platform 17 along its perimeter edge 17A. A second deck platform 19 is pivotally secured to and extends from said first deck platform 17 as best seen in FIGS. 1 and 2 of the drawings. The second deck platform 19 has a generally flat rectangular base portion 12 with an upstanding right angular flange 20A on its free edges. The hinge support and reinforcing element 18 extends and is secured to said second deck platform 19 opposite said first deck platform 17 as best seen in FIG. 1 of the drawings, thus hingeably interconnecting said respective deck platforms 17 and 19 to one another.

In the preferred form of the invention a pair of foldable support leg assemblies 21A can be seen, each having a main support leg 22 pivotally secured from a portion 23 of said flange 21. An elongated brace element 24 pivotally secured to said main support leg 22 inwardly from its free end at 25 and to said transom area 16 at 26 respectively.

Figure 3:
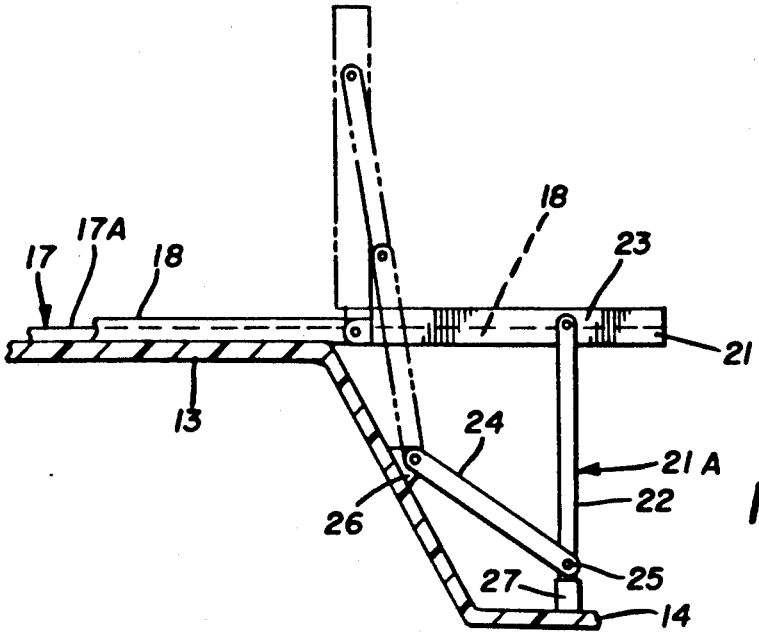
FIG. 3 is a graphic illustration of the sun deck extension's support legs relative position during use and partial deployment.
Figure 4:
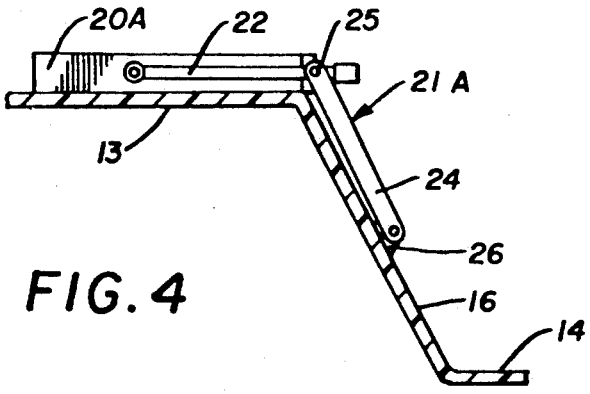
FIG. 4 is a graphic illustration of the sun deck's support legs in folded closed position.

It will be evident that upon opening of the device from the closed position illustrated in FIG. 2 of the drawings that the foldable support leg assemblies 21A positioned on either end of said deck platform 19 will automatically unfold as seen in FIGS. 1, 3, and 4 of the drawings. The deployment of the leg assembly 21A to its open support position as seen in FIG. 3 will provide outboard support for the second deck platform 19, thus effectively doubling the usable sun deck space available on the power boat 10.

It should be noted that in closed position the support leg assembly 21A folds beside said respective flange portion 23 and flat against said transition area 16 seen in FIG. 4 of the drawings. Rubber feet 27 are respectively positioned on each of said free ends of said main legs 22 so as to provide a cushion engagement with said lower deck 14.

In use, a pair of cushions 28A and B are positioned and respectively secured to the first and second deck platform 17 and 19. Each of said cushions 28A and B can be of an specific design configuration which has been determined suitable for boat use as to fabric, filling material and floatation requirements optionally required in marine use.

Figure 5:
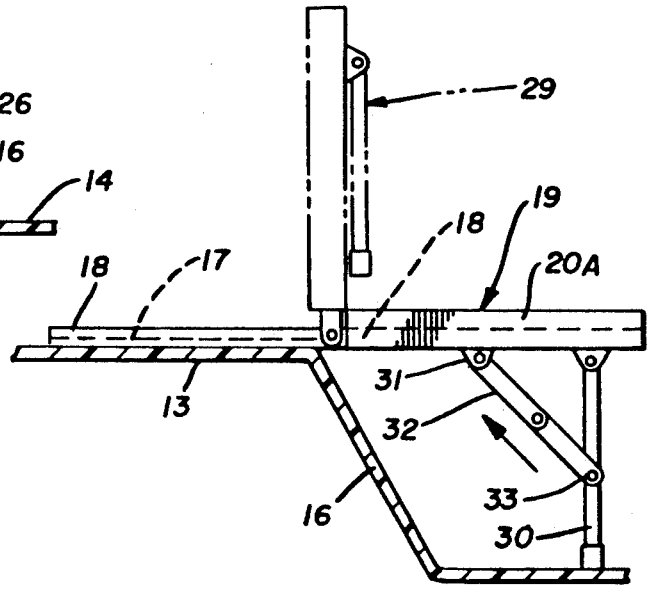
FIG. 5 is a graphic illustration of an alternate form of the invention defining alternate leg support systems relative position during use.
Figure 6:
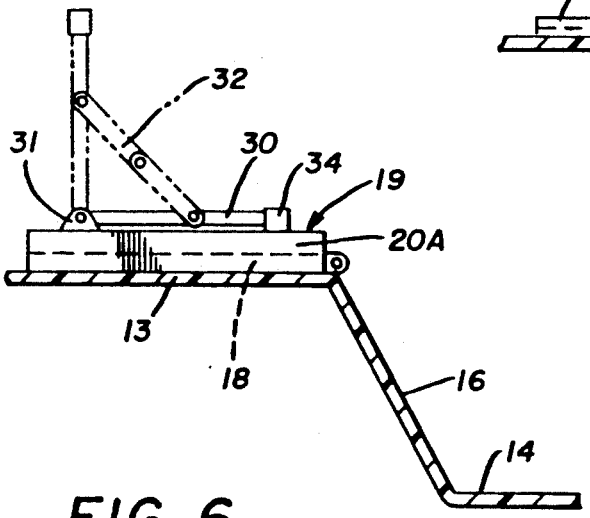
FIG. 6 is a graphic illustration of the alternate form of the invention in FIG. 5 in closed and in used position.
Figure 7:
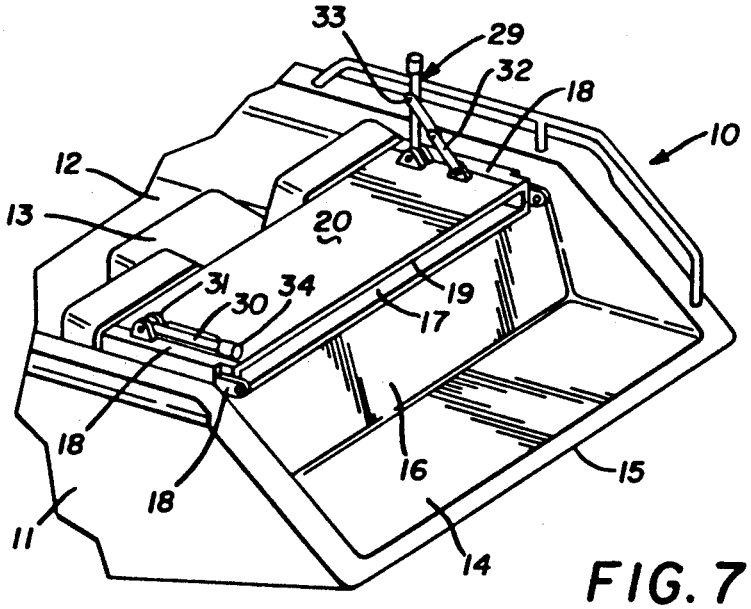
FIG. 7 is a partial perspective view of a boat with alternate support leg system partially deployed in closed position.

Referring now to FIGS. 5, 6, and 7 of the drawings, an alternate form of the invention can be seen having a modified leg support assembly 29. A pair of leg support assemblies 29 which are positioned on said second deck platform 19 in spaced oppositely disposed relation to one another adjacent said respective flange portion 21 hereinbefore described. Each of said alternate leg support assemblies 29 have a support leg 30 pivotally secured to said second deck platform 19 on the flat rectangular base 20 via a bracket 31. An angle brace 32 extends between said support leg 30 and said secondary deck platform 19. The angle brace 32 has a pivot point 33 midway its overall length as is typical in such brace configurations well known within the art.

It can be seen that once said leg support assemblies 29 are manually extended that said second deck platform 19 can be opened to a used positioned best illustrated in FIG. 5 of the drawings. Rubber feet 34 are positioned on the free ends of said support legs 30 for cushion engagement with s id lower deck 14 as hereinbefore described.

Thus it will be seen that a new and novel sun deck extension for boats has been illustrated and described and that various changes and modifications may be made therein without departing from the spirit of the invention, therefore

I claim:

1. An improvement in a sun deck extension for use on a boat having a hull, an interior deck surface, upper and lower decks a transition area between said decks said improvement including in combination, first and second deck platforms a hinged support and reinforcing elements secured to said first and second deck platforms adjacent said boat hull, means for securing said first deck platform to said upper deck of said boat, an upstanding flange extending from free edges of said second deck platform a foldable leg support assembly having a main support leg and an interconnected brace element, said support leg and said brace element being parallel to said deck and said transition area respectively when said sun deck extension is in a closed position, said second deck platform engagable on said first deck platform in said closed position and in spaced parallel relation to said lower deck in an open position.

2. The combination of claim 1 wherein said first and second deck platforms are of equal size.

3. The improvement in a sun deck extension for use on a boat having a hull, an upper and lower deck, a transition area between said decks, said improvement including in combination, a first and second deck platforms pivotally secured to one another, a hinged support element secured to said first and second deck platforms respectively said second deck platform comprising a flat rectangular base, an upstanding flange extending from said flat rectangular base, said first deck platform secured to said upper deck, a support leg assembly having a support leg pivotally secured to said rectangular base, an angular base extending from said leg to said rectangular base said second deck platform engagable on said first deck platform in a closed position and in a spaced parallel relation to said lower deck in an open position.

* * * * *